US009481544B2

(12) United States Patent
Schröder

(10) Patent No.: US 9,481,544 B2
(45) Date of Patent: Nov. 1, 2016

(54) CABLE GUIDE FOR FIBRES THAT ARE COMBINED IN CABLES

(75) Inventor: Rolf Schröder, Langen (DE)

(73) Assignee: OERLIKON TEXTILE GMBH & CO. KG, Remscheid (DE)

( * ) Notice: Subject to any disclaimer, the term of this patent is extended or adjusted under 35 U.S.C. 154(b) by 381 days.

(21) Appl. No.: 14/124,437

(22) PCT Filed: Jun. 6, 2012

(86) PCT No.: PCT/EP2012/060693

§ 371 (c)(1),
(2), (4) Date: Dec. 6, 2013

(87) PCT Pub. No.: WO2012/171837

PCT Pub. Date: Dec. 20, 2012

(65) Prior Publication Data

US 2014/0117146 A1 May 1, 2014

(30) Foreign Application Priority Data

Jun. 11, 2011 (DE) ..... 10 2011 104 062

(51) Int. Cl.

| | |
|---|---|
| ***B65H 57/16*** | (2006.01) |
| ***B65H 57/02*** | (2006.01) |
| *D02H 13/16* | (2006.01) |

(52) U.S. Cl.

CPC ..... *B65H 57/16* (2013.01); *B65H 57/02* (2013.01); *B65H 2701/314* (2013.01); *B65H 2701/38* (2013.01); *D02H 13/16* (2013.01)

(58) Field of Classification Search

CPC B65H 57/02; B65H 57/16; B65H 2701/314; B65H 2701/38; D02H 13/16; D02H 13/18; D02H 13/20; D02H 9/00; D02H 9/02

See application file for complete search history.

(56) References Cited

U.S. PATENT DOCUMENTS

| | | | | |
|---|---|---|---|---|
| 3,168,390 | A | 2/1965 | Theobald | |
| 3,220,666 | A | 11/1965 | Phillips et al. | |
| 3,520,493 | A * | 7/1970 | Carroll | B65H 57/16 242/131.1 |
| 3,734,374 | A | 5/1973 | Perry | |

FOREIGN PATENT DOCUMENTS

| | | |
|---|---|---|
| DE | 2124486 B | 12/1972 |
| FR | 2541621 | 8/1984 |
| GB | 441333 | 1/1936 |
| WO | 2008/044241 A2 | 4/2008 |

* cited by examiner

*Primary Examiner* — William E Dondero
(74) *Attorney, Agent, or Firm* — FisherBroyles, LLP; Robert Kinberg

(57) ABSTRACT

In a cable guide for fibers, particularly carbon fibers, which are combined into cables and extend in a transport direction in a transport plane, characterized in that the cable guide comprises a plurality of individual pins for separating said cables consisting of fibers, it is provided that the pins relative to the transport direction of the cables are inclined in the transport direction and together with the transport plane include an angle from 20° to 70°.

8 Claims, 2 Drawing Sheets

CABLE GUIDE FOR FIBRES THAT ARE COMBINED IN CABLES

The invention relates to a cable guide for fibers combined into cables, particularly carbon fibers, and to a method for the guidance of fibers combined into cables, particularly carbon fibers.

For fibers combined into cables, particularly endless fibers, cable guides are known which are used in pulling units arranged e.g. in fiber paths between individual processing units. In the pulling units, the cables are guided through driven rollers and are transported in a transport direction in a transport plane. The cable guide comprises a plurality of pins for separating said cables consisting of fibers. The pins are arranged adjacent to each other in a direction extending in parallel to the transport plane and substantially orthogonally to the transport direction.

However, in case of cables comprising particularly fragile fibers, such as e.g. carbon fibers, the problem exists that the fibers may easily be damaged in such a cable guide. Such an occurrence is of disadvantage particularly because the fibers are preferably endless fibers and such damage will disrupt the whole process.

Thus, it is an object of the invention to provide a cable guide for fibers combined into cables, particularly carbon fibers, wherein the probability of damage to the fibers is reduced.

According to the invention, it is advantageously provided that said pins, with respect to the transport direction of the cables, are inclined in the transport direction and together with the transport plane include an angle from 20° to 70°.

This has the advantage that, e.g. in case of knot formation in the cables, the special arrangement of the pins, i.e. the fact that the pins with respect to the transport direction of the cables are inclined in the transport direction and together with the transport plane include an angle from 20° to 70°, the fibers combined to a cable will slide over the pins together with the knots so that no damage can be incurred to the fibers.

The pins can include an angle with the transport plane from 30° to 50°, preferably from 43° to 47°, and most preferably an angle of 45°.

The pins can be resilient. Thus, the pins are bendable under the influence of pressure exerted by the cable onto the pins e.g. due to knot formation in the cables. The elasticity of the pins is provided in such a manner that they will not yield in regular operation but will only do so if the pressure from the cables is distinctly higher than in regular operation. This will happen e.g. if knots are formed in the cables. A "regular operation" is to be understood e.g. as an operation without knot formation.

The pins can be fastened on a traverse bar extending transversely to the direction of transport, while the pins can be detachable individually. Thus, the pins guiding the cables can be fixed to said traverse bar in a manner allowing them to be exchanged individually.

The pins can be fastened to the traverse bar by means of a clamping connection.

The traverse bar can be arranged relative to the transport plane in a manner allowing pins to be exchanged individually during operation. Further, the length of the pins must be selected to the effect that the pins can intersect the transport plane and separate the cables from each other and that, when pins are being exchanged, i.e. in case of detachment from the transverse bar, the persons exchanging the pins will not be endangered by the operation.

The traverse bar can comprise at least one first wall, said first wall extending substantially orthogonally to the pins, and the pins passing through a respective hole in the first wall of the traverse bar and, by a free end, being fastened to the traverse bar by a clamping connection on the side of the first wall facing away from the cables. This has the advantage that the pins can be detached from the traverse bar and that said first wall will protect the person detaching the pin, so that no human hand can inadvertently get into the transport plane of the cables.

The traverse bar can be formed as a hollow profile.

The traverse bar formed as a hollow profile can be open on one side. The traverse bar can be arranged relative to the cables in such a manner that the traverse bar does not touch the cables. This has the advantage that no friction will occur between the traverse bar and the cables, thus providing additional protection for the sensitive cables.

Alternatively, the traverse bar can comprise a surface on which the fibers and respectively filaments guided by the pins are moving in a sliding manner. Thus, there can be provided a cable guide for a fiber path, comprising a traverse bar along whose length individual pins are distributed while projecting out from the traverse bar, wherein the pins combined into cables extend between respective adjacent pins and wherein the traverse bar comprises a surface for sliding movement thereon of the fibers and respectively filaments guided by the pins.

On both of its ends, the traverse bar can comprise a respective attachment means by which the traverse bar can be mounted parallel to a provided roller of a pulling unit.

The traverse bar can comprise a plurality of surfaces supporting the fibers and respectively filaments, thus allowing the traverse bar to be mounted in different orientations relative to the guiding filament cables and respectively fiber cables.

The traverse bar can be formed as a profiled metal sheet. Said plurality of surfaces can each be formed by a respective surface of the profile.

According to the invention, there can further be advantageously provided a method for the guidance of fibers combined into cables, particularly carbon fibers, said method comprising the following steps:

- transporting of fibers combined into cables in a transport plane in transport direction,
- separating the cables consisting of fibers by a plurality of individual pins, wherein said pins relative to the transport direction of the cables are inclined in the transport direction and together with the transport plane include an angle from 20° to 70°.

Damaged pins can be replaced by new pins during continued operation.

An embodiment of the invention will be explained in greater detail hereunder with reference to the drawings.

In the drawings, the following is schematically shown:

Figure 1:
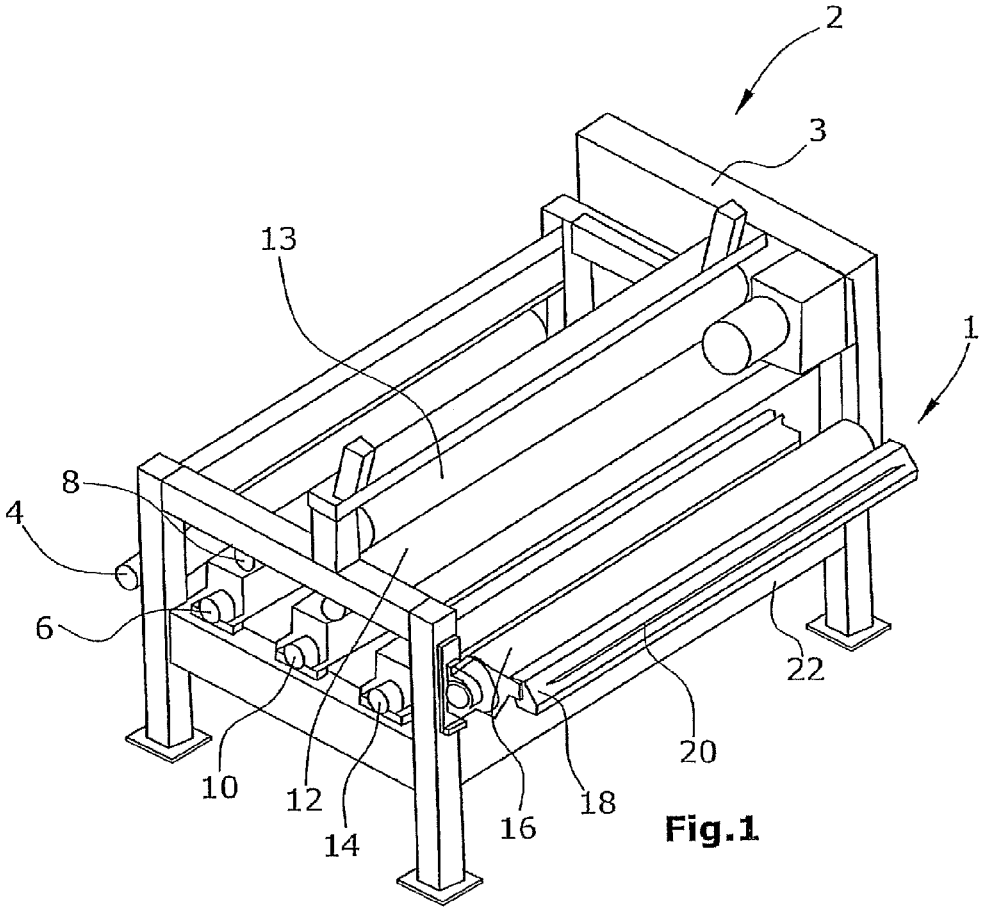
FIG. 1 is a perspective view of a pulling unit with cable guide.

FIG. 1 shows a perspective view of a pulling unit 2 comprising a cable guide 1. Said pulling unit can be arranged e.g. in a fiber path between two processing stations. The pulling unit 2 comprises a support structure 3 in which rollers 4, 6, 8, 10, 12, 13, 14 and 16 are supported. The rollers 6, 8, 10 can be driven by chain or belt drives, not shown. One of the rollers, 12, cooperates with a counter roller 13 which on both ends thereof is adjustably supported in support structure 3. The rollers of the pulling unit can also be referred to as pulling rollers.

Figure 2:
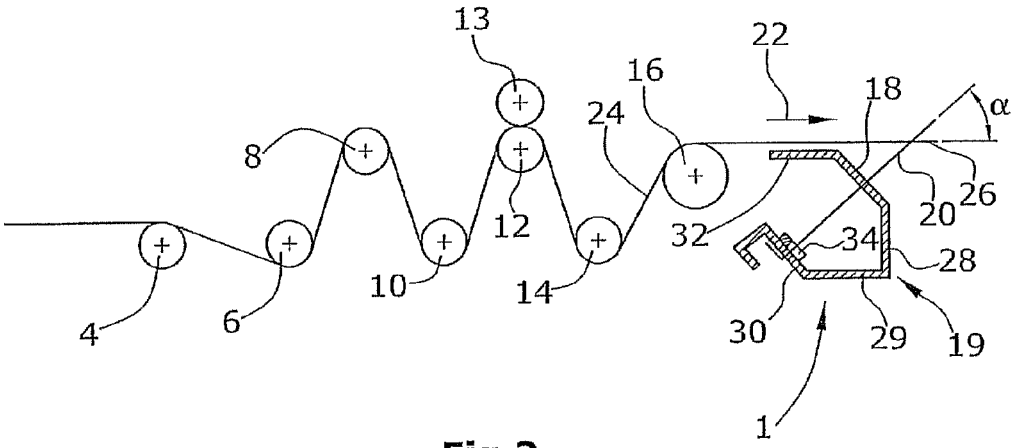
FIG. 2 is a schematic view of the arrangement of the pulling rollers and the cable guide.

In FIG. 2, the rollers 4, 6, 8, 10, 12, 13, 14 and 16, the cable guide 1 as well as the fibers 24 combined into cables are schematically illustrated. Said cables each comprise a plurality of fibers. A strand or bundle of fibers forms a respective cable. The fibers preferably are endless fibers. These endless fibers can also be referred to as filaments.

The fibers 24 combined into cables are transported through the pulling unit 2 with the aid of said rollers. At the end of the pulling unit 2, an output roller 16 is arranged. The fibers 24 combined into cables will be transported farther in the transport direction while moving in a transport plane 26.

In the region of output roller 16, the cable guide 1 is arranged.

Figure 3:
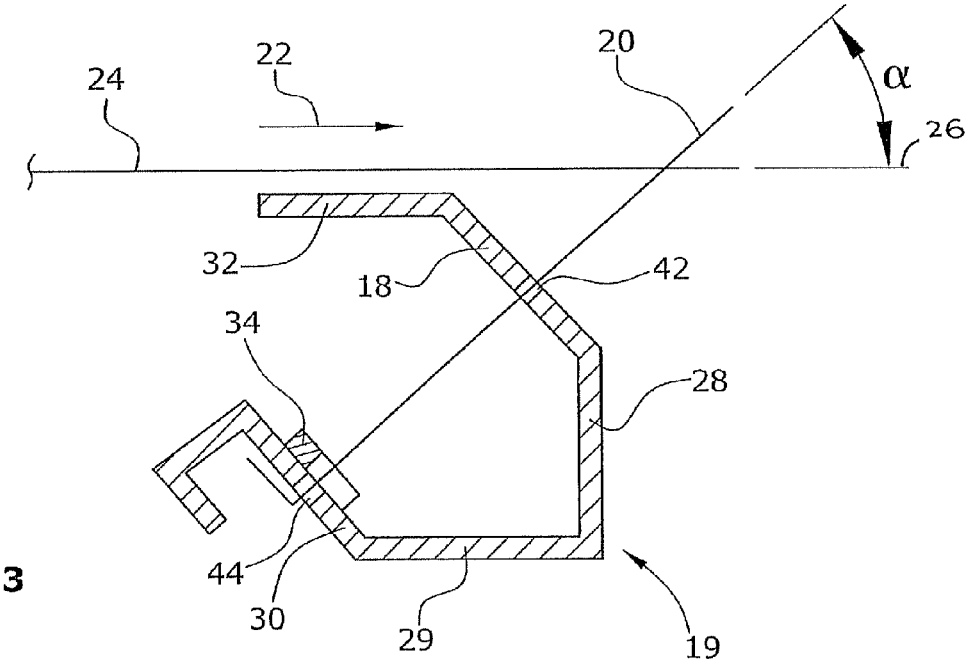
FIG. 3 is an enlarged view of the cable guide.

Cable guide 1 is shown in greater detail in FIG. 3. FIG. 3 is a sectional view of cable guide 1. The cable guide comprises a traverse bar 19. The traverse bar 19 is formed as an open hollow profile. This open hollow profile comprises a plurality of walls 32, 18, 28, 29, 30. Also shown are the fibers 24 combined into cables, extending in the transport plane 26 in transport direction 22.

Cable guide 1 comprises a plurality of individual pins 20 for separating the cables 24 consisting of the fibers.

In FIG. 3, said pins 20 are shown in lateral view. The pins 20 are arranged side by side to each other in a direction extending in parallel to the transport plane 26 and orthogonally to the transport direction 22. For this reason, only one pin is visible in the lateral view of FIG. 3. The individual pins 20 each extend in a plane which is oriented orthogonally to the transport plane 26. The pins 20 are arranged in such a manner that they intersect the transport plane 26. The pins are preferably made of flexible stainless steel.

Relative to the transport direction 22 of the cables 24, the pins 20 are inclined in the transport direction 22 and together with the transport plane 26 include an angle $\alpha$ from 20° to 70°. This angle can preferably be in the range from 30° to 50° and most preferably is 45°. This has the advantage that, in case of knots being formed in the fibers 24 combined into cables, these knots will be able to slide over the pins 20, thus preventing damage to the fibers 24 combined into cables.

Further, the pins 20 are preferably resilient. Thus, the pins 20 are capable of being bent under the influence of pressure that is exerted by the cables 24 onto the pins 20 in a situation of knot formation in the cables 24. The resiliency of the pins 20 is selected in an adequate manner to prevent bending of the pins during regular operation. The pins should yield in a spring-elastic manner only e.g. if knots happen to develop in the fibers 24 combined into cables and this knot formation causes the fibers 24 combined into cables to exert an increased pressure onto the pins.

This has the additional advantage of a further reduction of the risk of damage to the fibers 24 combined into cables.

The pins 20 are each fastened to the traverse bar 19 by a clamping device and respectively clamping connection 34. Traverse bar 19 comprises a first wall 18 formed with a throughgoing bore 42 for each pin 20. All of the pins 20 are inserted into and held in their respective bore 42. The bore 42 is slightly larger in diameter than the diameter of the respective pin 20. Pin 20 is additionally inserted through a hole 44 in the second wall 30 of traverse bar 19.

Now, in the event of damage to an individual pin 20 during operation, the individual damaged pin 20 can be exchanged during operation. For this purpose, it can be possible, on the one hand, after releasing the clamping connection 34, to pull the pin 20 through the appertaining holes 42 and respectively 44 formed in the first and respectively second wall 18,30. On the other hand, if the pin 20 has been bent and thus cannot be pulled anymore through the hole 42 in the first wall or through the hole 44 in the second wall 30, the individual pin 20 can be cut off by use of a pincers either on the side of the first wall 18 facing toward the cables, or in the hollow profile of the traverse bar 19 between the first wall 18 and the second wall 30.

Thus, the traverse bar 19 is arranged relative to the cables 24 in a manner allowing the respective pins 20 to be exchanged during operation.

Said clamping device and respectively clamping connection 34 is e.g. a metallic element comprising a tapering slot by which the metallic element will be shifted onto the pin 20, which, due to the tapering shape of the slot, will result in a clamping effect.

Figure 4:
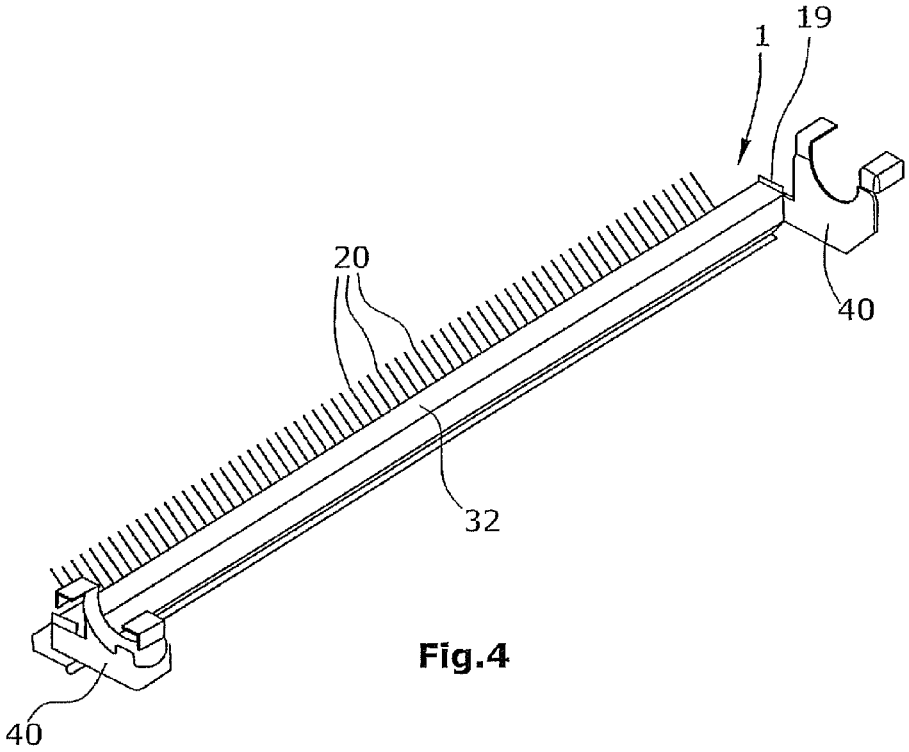
FIG. 4 is a perspective view of the cable guide.

In FIG. 4, the traverse bar 19 is shown. The traverse bar 19 is provided, at the respective ends, with respectively one fastening device 40 by which the traverse bar 19 can be fastened to the support structure 3, the traverse bar 19 extending axially parallel to the output roller 16. Further illustrated are the plurality of pins 20 which are fastened in the traverse bar 19. For better survey, FIG. 4 shows pins 20 only in a number small enough to still allow the viewer to realize that these are individual pins 20. In real practice, there will be used a larger number of pins 20, and these will be arranged on the traverse bar 19 at smaller mutual distances.

The invention claimed is:

1. A cable guide for fibers combined into cables, said fibers extending in a transport direction in a transport plane, said cable guide comprising:

a traverse bar for being mounted on support structure of the cable guide to extend transverse to the transport direction of the fibers; and a plurality of individual pins for separating said cables consisting of fibers, wherein the pins are individually and detachably fastened to the traverse bar and arranged side by side to each other in a direction extending substantially transversely to the direction of transport, wherein said pins relative to the transport direction of the cables are inclined in the transport direction and together with the transport plane include an angle from 20° to 70°;

wherein the traverse bar comprises at least a first wall extending substantially orthogonally to the pins, the pins pass through respective holes in the first wall of the traverse bar and by a free end are fastened to the traverse bar by a clamping connection on a side of the first wall facing away from the cables; and wherein the pins which pass through a respective hole in the first wall can be pulled out from the side of the first wall facing away from the cables and the traverse bar is arranged relative to the transport plane to allow the pins to be exchanged during operation of the cable guide.

2. The cable guide of claim 1, wherein the angle included by the pins together with the transport plane is from 30° to 50°.

3. The cable guide of claim 1, wherein the pins are resilient so that the pins are bendable under the influence of pressure exerted by the cables onto the pins due to knot formation in the cables.

4. The cable guide of claim 1, wherein the traverse bar is formed as a hollow profile.

5. The cable guide of claim 4, wherein the traverse bar comprise a hollow profile having a side that is open.

6. The cable guide of claim 4, wherein the traverse bar is arranged relative to the cables so that the traverse bar does not touch the cables.

7. The cable guide of claim 1, wherein the traverse bar comprises, on both of its ends, a respective attachment by which the traverse bar is mountable parallel to a provided roller of a pulling unit.

8. A method for guidance of fibers combined into cables, said method comprising:

transporting the cables in a transport plane in transport direction, separating the cables consisting of fibers by a plurality of pins individually and detachably fastened to a traverse bar and arranged side by side to each other in a direction extending substantially transversely to the transport direction, said pins relative to the transport direction of the cables being inclined in the transport direction and together with the transport plane including an angle from 20° to 70°, wherein the traverse bar comprises at least a first wall extending substantially orthogonally to the pins, the pins pass through respective holes in the first wall of the traverse bar and by a free end are fastened to the traverse bar by a clamping connection on a side of the first wall facing away from the cables, and the pins which pass through a respective hole in the first wall can be pulled out from the side of the first wall facing away from the cables; and replacing damaged pins with new pins during continued operation of the transporting of the cables.

* * * * *